US006089899A

United States Patent [19]

Wang et al.

[11] Patent Number: 6,089,899

[45] Date of Patent: Jul. 18, 2000

[54] MODULE CARD RETAINER DEVICE

[75] Inventors: Pei-Rong Wang; Kuang-Man Fang, both of Tu-Chen, Taiwan

[73] Assignee: Hon Hai Precision Ind. Co., Ltd., Taipei Hsien, Taiwan

[21] Appl. No.: 09/192,869

[22] Filed: Nov. 16, 1998

[30] Foreign Application Priority Data

Nov. 15, 1997 [TW] Taiwan ..... 86219255

[51] Int. Cl.[7] ..... H01R 13/645

[52] U.S. Cl. ..... 439/377; 439/64

[58] Field of Search ..... 439/325, 327, 439/377, 64; 361/801, 802

[56] References Cited

U.S. PATENT DOCUMENTS 5,943,218 8/1999 Liu ..... 361/801

5,980,299 11/1999 Davis ..... 439/377

*Primary Examiner*—Lincoln Donovan

*Assistant Examiner*—Eugene G. Byrd

[57] ABSTRACT

A module card retainer includes a base closure having two elongate side walls connected to two U-shaped end walls and defining a slot therebetween. Two clamping arms each have a central plate and two side plates pivotably connected to two side wall portions of the U-shaped end wall, respectively. Each clamping arm defines an inner channel between the central plate and the side plates. A seat is attached to each side wall portion of the U-shaped end wall. A locking member is retained in the seat and cooperates with a bolt to fix the seat onto a mother board.

20 Claims, 7 Drawing Sheets

MODULE CARD RETAINER DEVICE

BACKGROUND OF THE INVENTION

1 . Field of the Invention

The present invention relates to a module card retainer device for use in a personal computer, and particularly to a retainer device which can easily and effectively fix a module card or the like onto a printed circuit board.

2 . The Prior Art

Modularized PC boards and CPU cards have become a trend in the PC industry. Traditionally, a CPU is connected to a mother board either via a connector or direct soldering. However, an advanced manufacturing technique has replaced this method by firstly soldering the CPU onto a printed circuit board and then inserting the printed circuit board into a connector mounted on the mother board. Alternatively, the CPU is firstly combined with the PC board as a modularized unit and is then inserted into a connector mounted on the mother board. However, either the PC board or the modularized card is elevated above the connector, therefore, the PC board or the modularized card is apt to vibrate and adversely affect signal transmission. Normally, a retainer device is configured beside the connector in order to further fix the PC board or the modularized card. The related U.S. Pat. Nos. are 5,259,793, 5,429,523 and 3,829,741.

A conventional retainer device 1 shown in FIG. 1 is formed by integrated injection molding and comprises a base closure 11 from two distal ends of which two clamping arms 12 extend. Two seats 13 are respectively formed adjacent to two lower sides of each clamping arm 12. Each clamping arm 12 defines an inner channel 121 confronting each other and cooperating to receive a module card (not shown) therebetween. The base closure 11 defines a slot 111 for retaining a connector (not shown) into which a module card (not shown) or the like is inserted. Each seat 13 defines a cavity 131 for receiving a corresponding locking member 14. Each seat 13 defines an opening 1311 at a top thereof and a hole 1312 in a base thereof. Each locking member 14 has a base 142 and a vertical portion 141 extending upward from the base 142. A threaded hole (not shown) is defined from the base 142 through the vertical portion 141 for matingly engaging with a bolt (not shown). The base 142 is sized to be larger than the hole 1312 yet smaller than the opening 1311 defined in the seat 13. Each pair of locking members 14 and the corresponding bolts together form a board lock means for securing the retainer device 1 onto a printed circuit board (not shown). During assembly, the locking member 14 is positioned from the opening 1311 onto a base of the cavity 131, with the threaded hole thereof aligning with the hole 1312. A substantially L-shaped positioning metal plate 15 defines a hole 151 therein for securing around the vertical portion 141 of the locking member 14 and has a tab 152 extending from one side thereof for engaging with a reception hole 132 defined in an upright wall of the seat 13. A bent portion 153 formed on another side of the positioning metal plate 15 engages with a recess 1313 defined in an outer lower wall portion of the seat 13. After the locking member 14 is fixed in the cavity 13 by means of the positioning metal plate 15, the retainer device 1 may be positioned on a printed circuit board and fixed thereon by the bolts.

During assembly, the alignment of the locking member 14 with the hole 1312 becomes tedious and time consuming. Moreover, the extra positioning metal plate 15 and the laborious assembly thereof with the locking member 14 increases assembly time and manufacturing costs. In addition, the clamping arms 12 occupy too much space and are easily damaged during transportation due to the extended length thereof. Therefore, an improved retainer for overcoming the above problems is requisite in this field.

SUMMARY OF THE INVENTION

The primary purpose of the present invention is to provide a module card retainer having a simplified structure thereby conserving time during assembly.

A second purpose of the present invention is to provide a foldable module card retainer which is not easily damaged during packaging or transport.

In accordance with one aspect of the present invention, a module card retainer comprises a base closure having two elongate side walls connected to two U-shaped end walls and defining a slot therebetween. Two clamping arms each have a central plate and two side plates which are pivotably connected to two side wall portions of the U-shaped end wall. Each clamping arm defines an inner channel between the central plate and the side plates. A seat is attached to each side wall portion of the U-shaped end wall and defines a cavity therein on inner walls of which retaining means is formed for firmly retaining the locking member in the cavity. A locking member is retained in the seat and cooperates with a bolt to fix the seat onto a mother board.

In accordance with another aspect of the present invention, a module card retainer comprises a base closure having two elongate side walls connected to two U-shaped end walls and defining a slot therebetween. Two clamping arms each have a central plate and two side plates which are pivotably connected to two side wall portions of the U-shaped end wall. Each clamping arm defines an inner channel between the central plate and the side plates. A seat is attached to each side wall portion of the U-shaped end wall. A locking member is retained in the seat and cooperates with a bolt to fix the seat onto a mother board. A foldable mechanism is formed on the U-shaped end wall and the clamping arm for pivotably folding the clamping arm.

These and additional objects, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1:
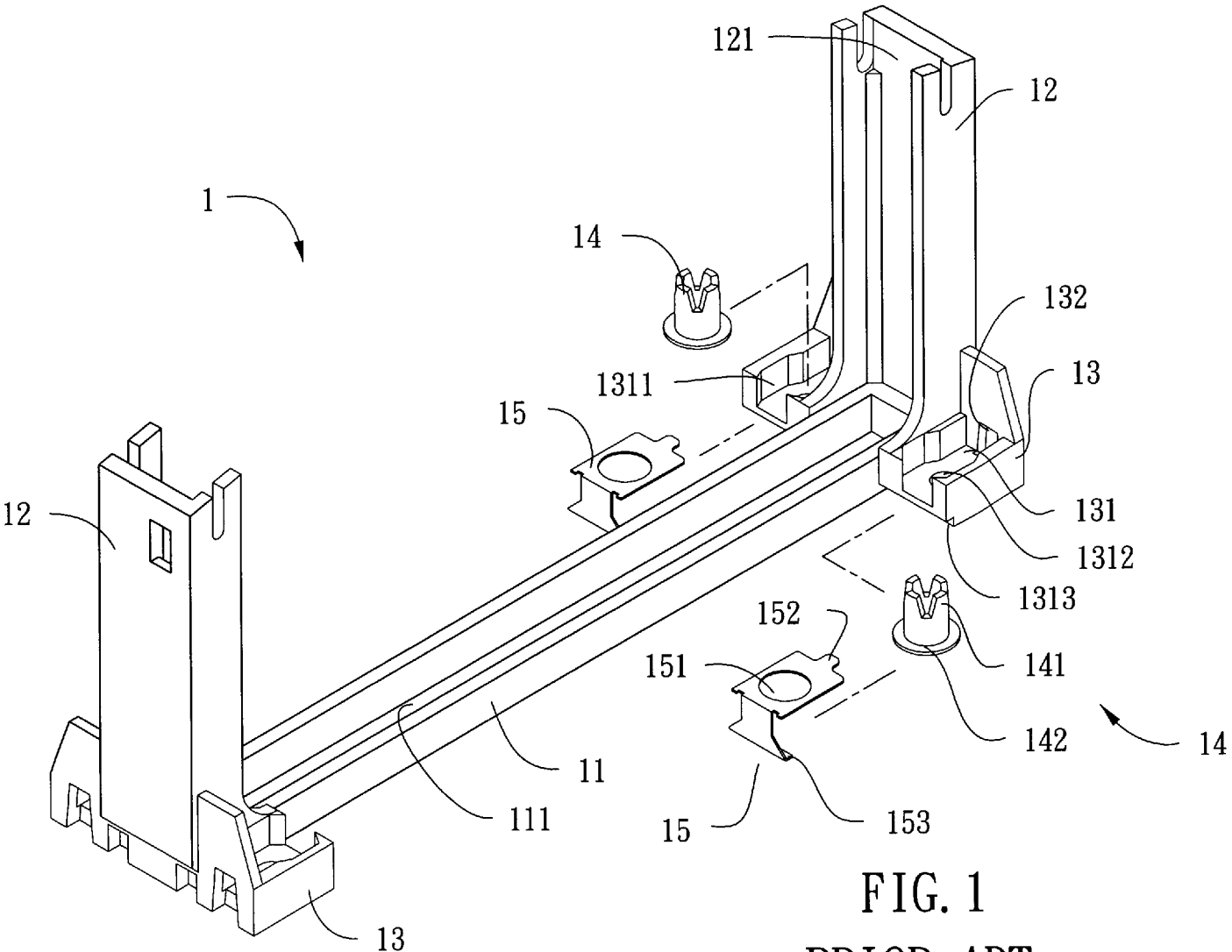
FIG. 1 PRIOR ART
FIG. 1 is a perspective view of a conventional retainer.
Figure 2:
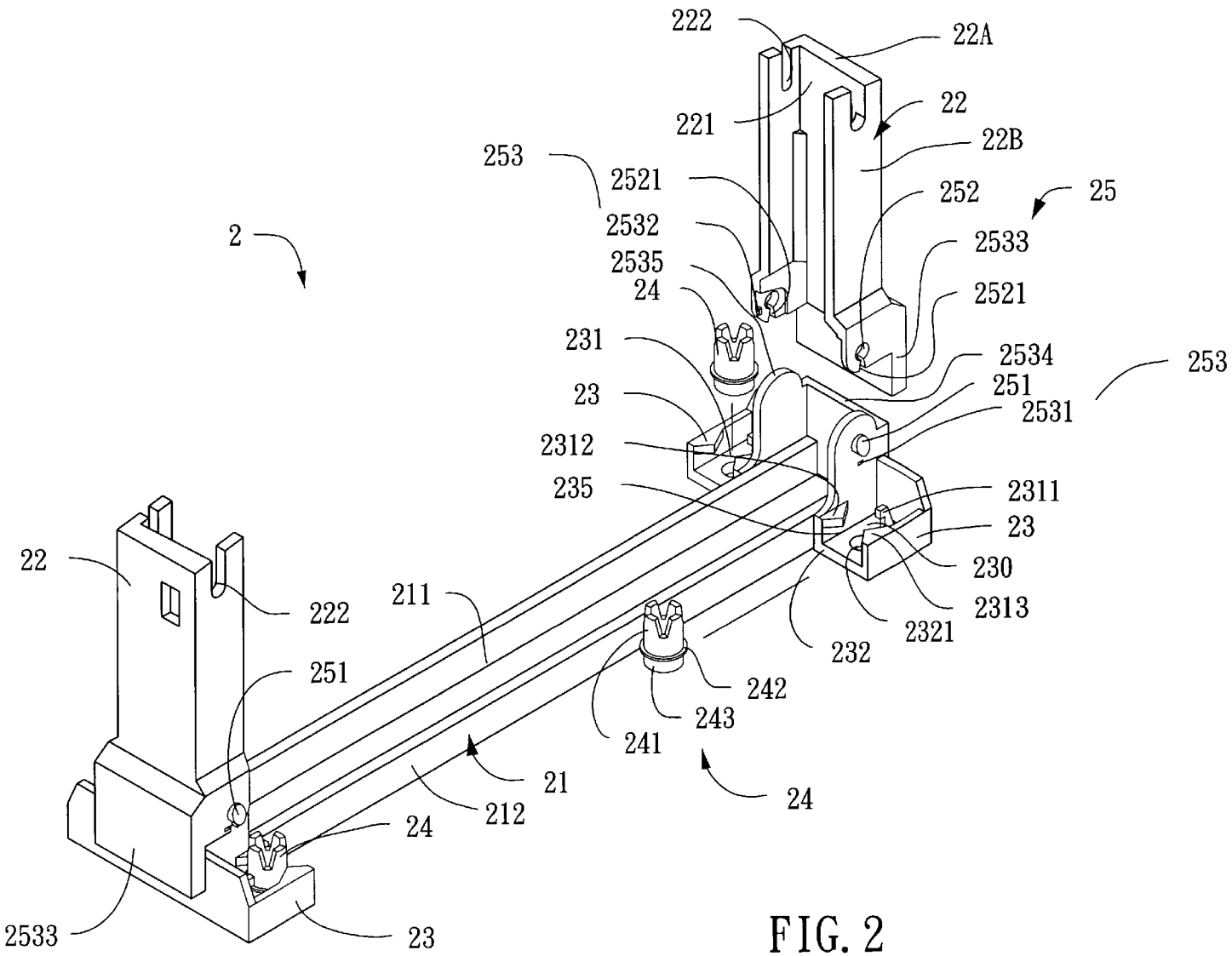
FIG. 2 is an exploded view of a retainer in accordance with the present invention.

Referring to FIG. 2, a module card retainer 2 in accordance with the present invention comprises a base closure 21 having two elongate side walls 212 connected to two U-shaped end walls 2534 and defining a slot 211 therebetween for receiving an external connector (not shown) which is further electrically connected to a module card (not shown). Two clamping arms 22 each having a central plate 22A and two side plates 22B pivotably connected to two side wall portions 2535 of the U-shaped end wall 2534 respectively, Each clamping arm 22 defines an inner channel 221 between the side plates 22B. The inner channels 221 of the clamping arms 22 confront each other for receiving the module card therebetween when the two clamping arms 22 are positioned perpendicular to the elongate side wall 212 of the base closure 21 (see FIG. 5). A seat 23 is attached to each side wall portion 2535 of the U-shaped end wall 2534. Also referring to FIG. 4B, a locking member 24 is retained in the seat 23 and cooperates with a bolt 4 to fix the seat 23 onto a mother board 3. A folding mechanism 25 is formed between the U-shaped end wall 2534 and the clamping arm 22 for allowing the clamping arm 22 to be pivotably folded when a module card is not retained between the two clamping arms 22.

Figure 3:
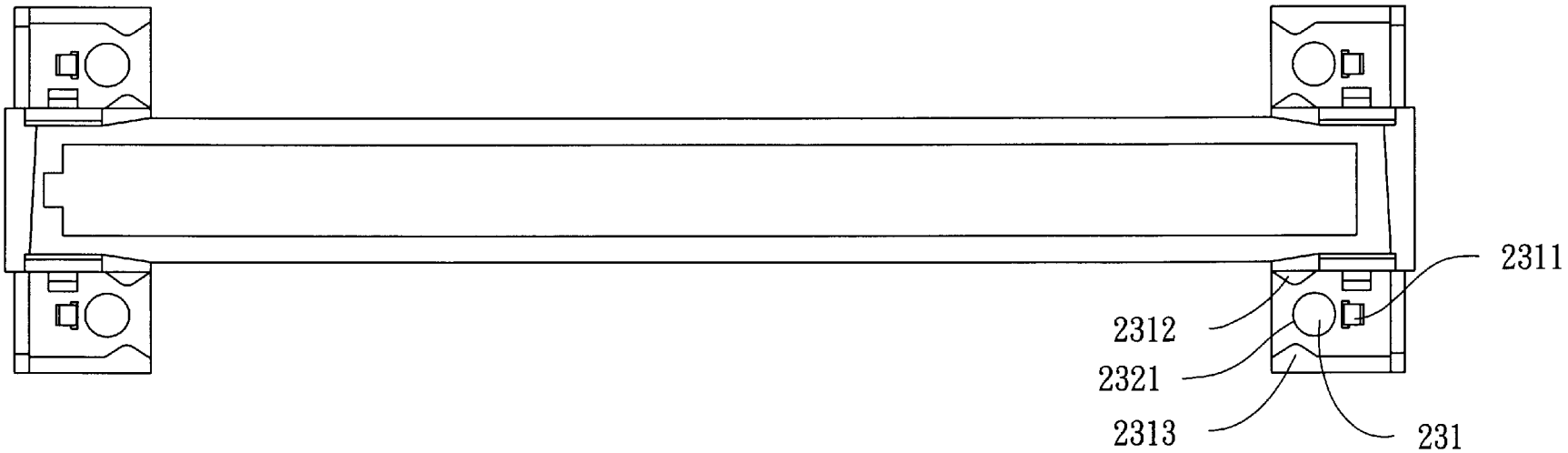
FIG. 3 is an elevational view of a base closure and four seats of the retainer of FIG. 2.
Figure 4A:
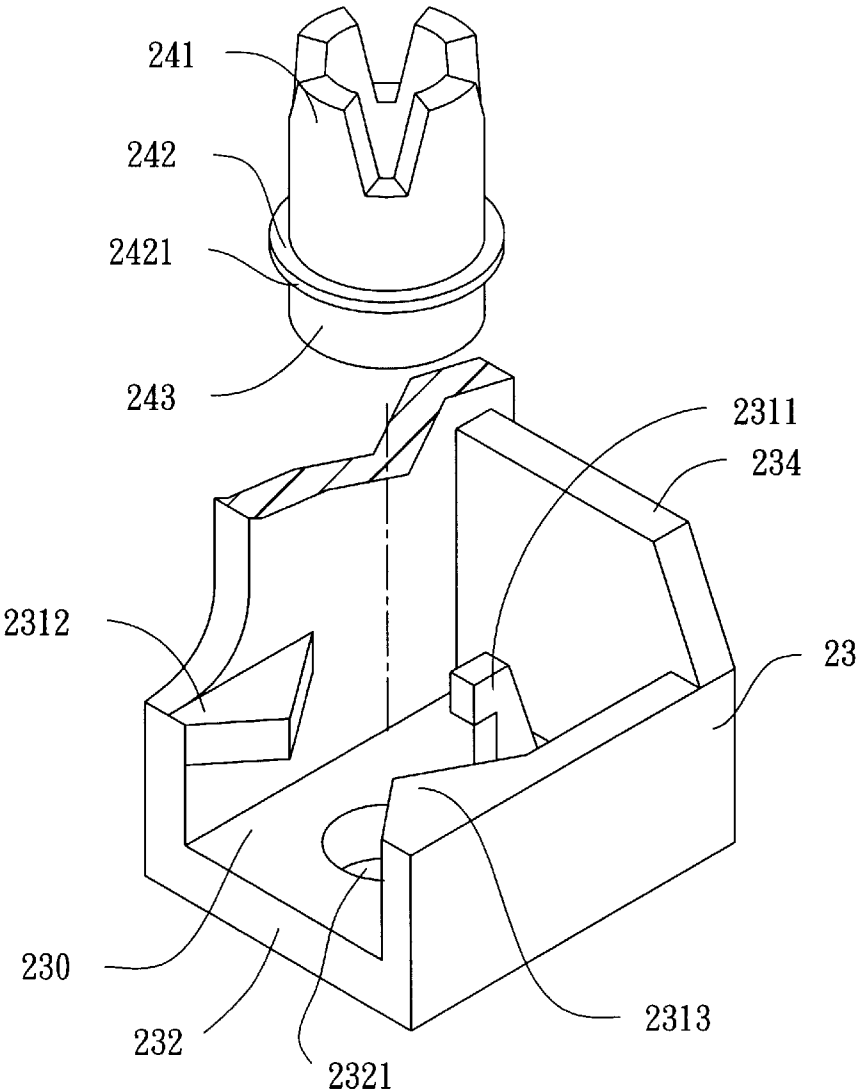
FIG. 4A is a partial view of the seat and a locking member before assembling to a mother board.
Figure 4B:
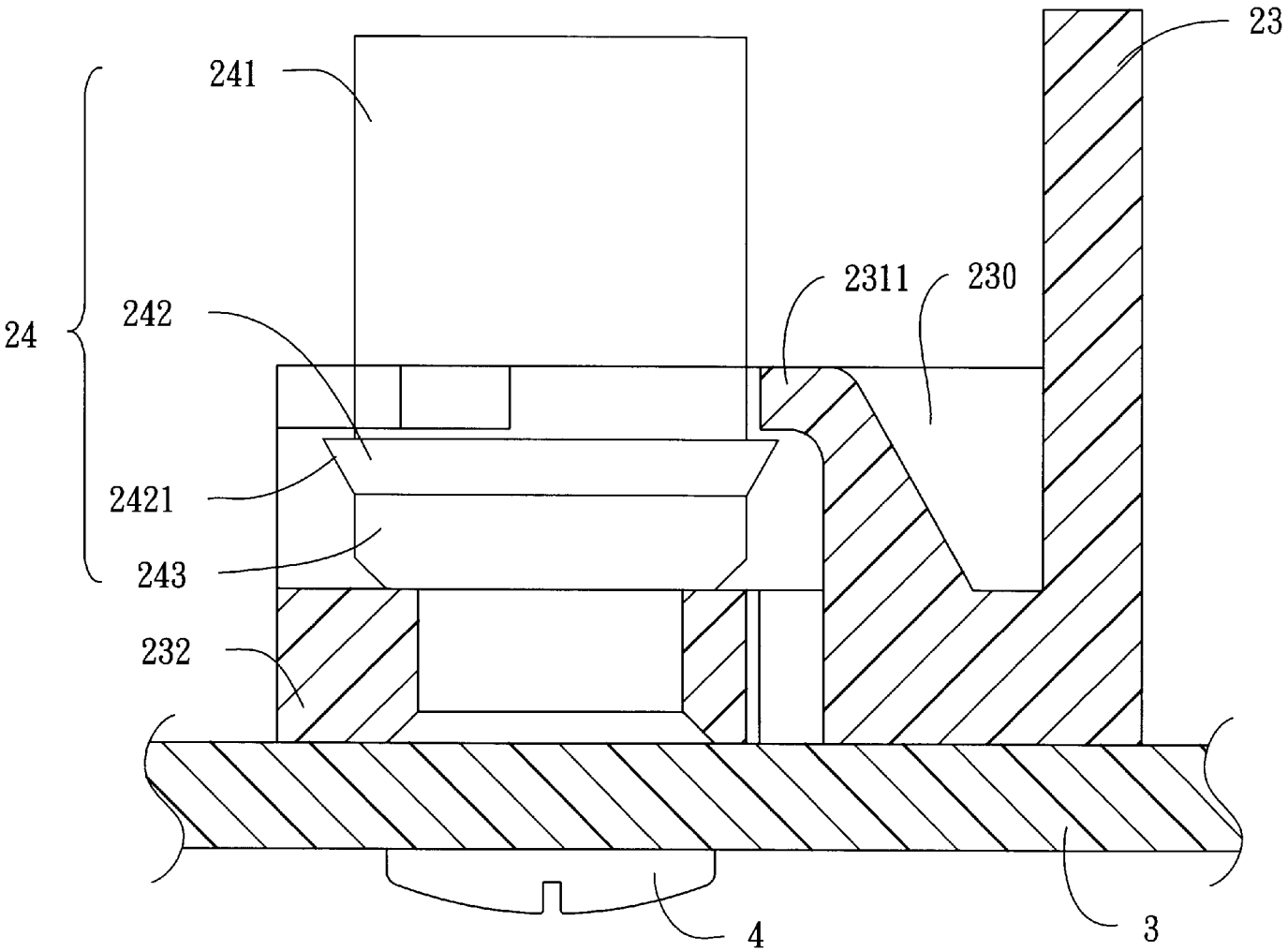
FIG. 4B is a cross-sectional view showing the engagement of the retainer with a mother board.

Also referring to FIGS. 3, 4A and 4B, the seat 23 includes a base 232 extending from the side wall portion 2535 of the U-shaped end wall 2534 and two side walls (not labeled) extending upward from two adjacent sides of the base 232 thereby defining a cavity 230 for receiving the locking member 24. The seat 23 includes a first retaining member 2311 extending upward from the base 232, a second retaining member 2312 extending laterally from the side wall portion 2535 of the U-shaped end wall 2534, and a third retaining member 2313 extending laterally from a side wall opposite the side wall portion 2535, thereby defining an upper opening 231 between the three retaining members 2311, 2312, 2313 through which the locking member 24 can be forcibly inserted and retained between the three retaining members 2311, 2312, 2313 and the base 232 of the seat 23, wherein the first retaining member 2311 is bendable when the locking member 24 is forcibly inserted into the cavity 230. The second and third retaining members 2312, 2313 are triangular plates facing each other thus defining a tapered gate space 235 allowing the locking member 24 to be forcibly and horizontally pushed therethrough and retained in the cavity 230.

Specifically referring to FIG. 4B, the locking member 24 includes a head portion 241 connected to a tapered leg portion 243 and a flange portion 242 extending from the intersection of the head portion 241 and the tapered leg portion 243, wherein the flange portion 242 has a tapered side face 2421 for sliding through the first, second and third retaining members 2311, 2312, 2313 when the locking member 24 is forcibly inserted into the cavity 230 of the seat 23.

The folding mechanism 25 comprises pivotable means for providing a pivotable interconnection between each clamping arm 22 and the corresponding U-shaped end wall 2534. The pivotable means comprises a pivot 251 extending from the side wall portion 2535 of the U-shaped end wall 2534 and a pivot hole 252 defined in the side plate 22B of the clamping arm 22 for pivotably engaging with the pivot 251. The pivot 251 has a slanted top surface for facilitating engagement with the pivot hole 252. Each pivot hole 252 is exposed to an edge of the corresponding side plate 22B of the clamping arm 22 via a cutout 2521. For facilitating engagement with the pivot 251 and preventing the pivot 251 from becoming dislodged from the pivot hole 252 during pivotable movement of the clamping arm 22, the cutout 2521 is tapered narrower from the edge of the corresponding side plate 22B toward the pivot hole 252.

Figure 5:
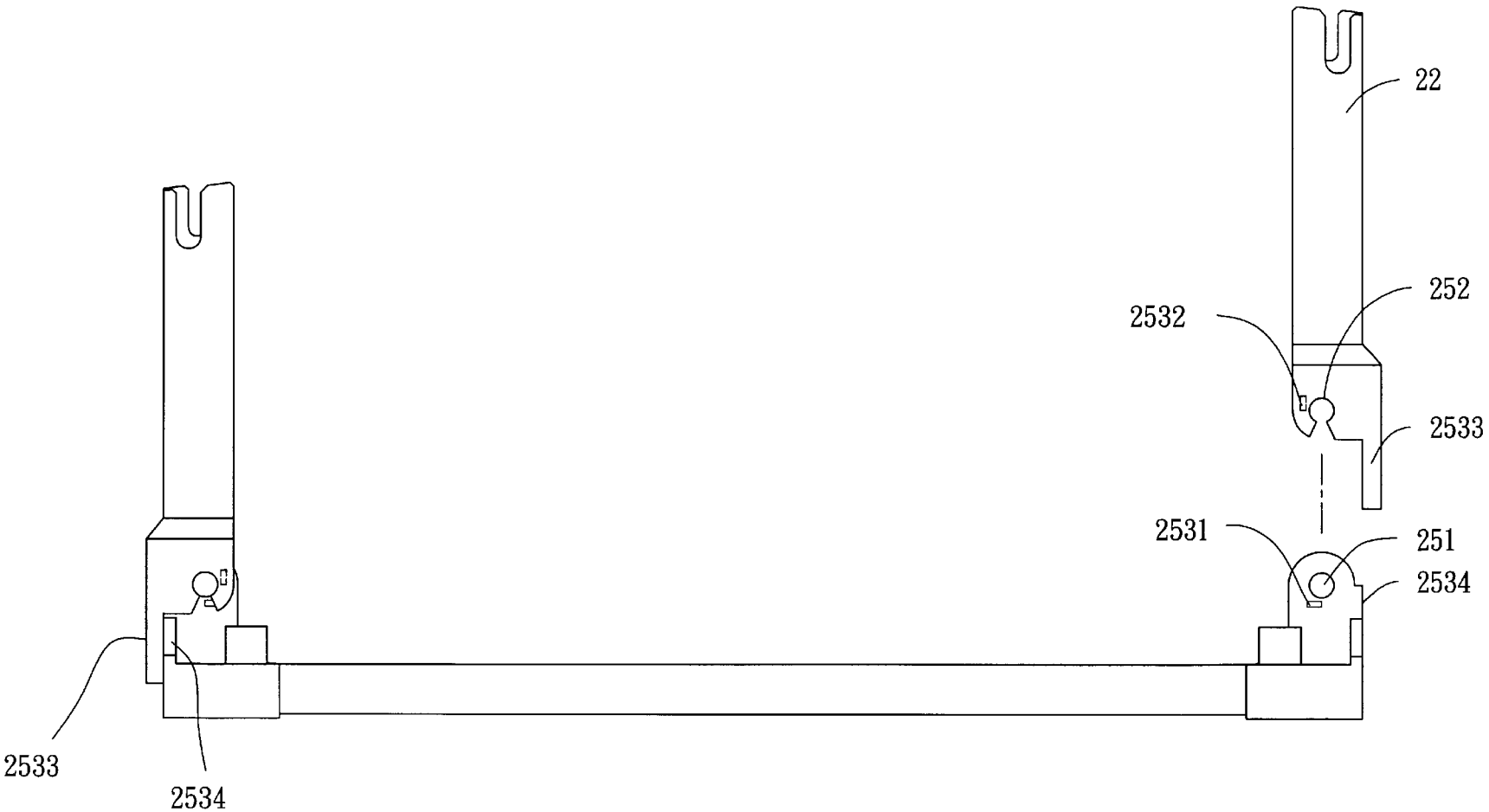
FIG. 5 is a side view of the retainer in an extended status.
Figure 6:
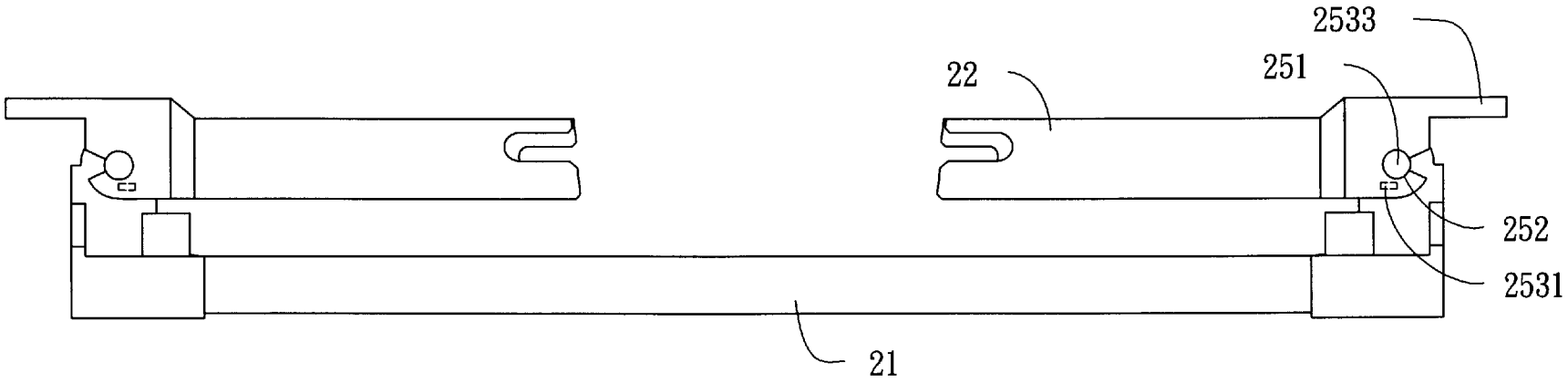
FIG. 6 is side view of the retainer in a folded status.

Also referring to FIGS. 5 and 6, the foldable mechanism 25 also comprises positioning means 253 for retaining the clamping arm 22 between an extended status and a folded status in which the clamping arm 22 is respectively perpendicular to and parallel to the elongate side wall 212 of the base closure 21. The positioning means 253 includes extended status positioning means for retaining the clamping arm 22 in the extended status and folded status positioning means for retaining the clamping arm 22 in the folded status. The extended status positioning means comprises a lower portion 2533 extending from the central plate 22A of the clamping arm 22 and a central plate portion of the U-shaped end wall 2534 thereby when the clamping arm 22 is pivotably moved to be perpendicular to the elongate side wall 212 of the base closure 21, the lower portion 2533 of the central plate 22A of the clamping arm 22 is stopped by the central plate portion of the U-shaped end wall 2534. The folded status positioning means comprises a recess 2531 defined in the side wall portion 2535 of the U-shaped end wall 2534 and a protrusion 2532 projecting from each of the side plates 22B of the clamping arm 22 for engaging with the recess 2531 when the clamping arm 22 is moved to the folded status. A conventional cutout 222 is defined in an upper edge of each side plate 22A, 22B of the clamping arm 22 for engaging with an upper portion of the module card.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A foldable module card retainer comprising:

a base closure having two elongate side walls connected to two U-shaped end walls and defining a slot therebetween;

two clamping arms each having a central plate and two side plates which are pivotably connected to two side wall portions of the U-shaped end wall, each clamping arm defining an inner channel between the central plate and the side plates;

a seat attached to each side wall portion of the U-shaped end wall;

a locking member retained in the seat and cooperating with a bolt to fix the seat onto a mother board; and a foldable mechanism formed on the U-shaped end wall and the clamping arm for pivotably folding the clamping arm.

2. The foldable module card retainer as claimed in claim 1, wherein the seat includes a base extending from the side wall portion of the U-shaped end wall and two side walls extending upward from two adjacent sides of the base thereby defining a cavity therein for receiving the locking member.

3. The foldable module card retainer as claimed in claim 1, wherein the seat comprises retaining means formed in the cavity for firmly retaining the locking member in the cavity.

4. The foldable module card retainer as claimed in claim 3, wherein the retaining means includes two retaining members extending from opposite walls of the cavity thereby defining a gate space therebetween through which the locking member is forcibly inserted and retained in the cavity.

5. The foldable module card retainer as claimed in claim 3, wherein the retaining means includes a first retaining member extending upward from the base, a second retaining member extending laterally from the side wall portion of the U-shaped end wall, and a third retaining member extending laterally from a side wall opposite the side wall portion of the U-shaped end wall, thereby defining an upper opening between the three retaining members through which the locking member can be forcibly inserted and retained between the three retaining members and the base of the seat.

6. The foldable module card retainer as claimed in claim 5, wherein the first retaining member is bendable when the locking member is forcibly inserted into the cavity.

7. The foldable module card retainer as claimed in claim 5, wherein the second and third retaining members are triangular plates facing each other thereby defining a tapered gate space allowing the locking member to be forcibly pushed therethrough and retained in the cavity.

8. The foldable module card retainer as claimed in claim 5, wherein the locking member includes a head portion connected to a tapered leg portion and a flange portion extending from the intersection of the head portion and the tapered leg portion.

9. The foldable module card retainer as claimed in claim 8, wherein the flange portion has a tapered side for sliding through the first, second and third retaining members when the locking member is forcibly inserted into the cavity of the seat.

10. The foldable module card retainer as claimed in claim 1, wherein the foldable mechanism comprises pivotable means for providing a pivotable interconnection between each clamping arm and the corresponding U-shaped end wall during pivotable movement of the clamping arm.

11. The foldable module card retainer as claimed in claim 10, wherein the foldable mechanism comprises positioning means for retaining the clamping arm between a folded status and an extended status in which the clamping arm is respectively parallel to and perpendicular to the elongate side wall of the base closure.

12. The foldable module card retainer as claimed in claim 10, wherein the pivotable means comprises a pivot extending from the side wall portion of the U-shaped end wall and a pivot hole defined in the side plate of the clamping arm for pivotably engaging with the pivot.

13. The foldable module card retainer as claimed in claim 12, wherein the pivot hole is exposed to an edge of the side late of the clamping arm via a cutout.

14. The foldable module card retainer as claimed in claim 11, wherein the positioning means includes extended status positioning means for retaining the clamping arm in the extended status and folded status positioning means for retaining the clamping arm in the folded status.

15. The foldable module card retainer as claimed in claim 14, wherein the extended status positioning means comprises a lower portion extending from the central plate of the clamping arm and a central plate portion of the U-shaped end wall thereby when the clamping arm is pivotably moved to be perpendicular to the elongate side wall of the base closure, the lower portion of the central plate of the clamping arm is stopped by the central plate portion of the U-shaped end wall.

16. The foldable module card retainer as claimed in claim 14, wherein the folded status positioning means comprises a recess defined in the side wall portion of the U-shaped end wall and a protrusion extending from the side plate of the clamping arm for engaging with the recess when the clamping arm is moved to the folded status.

17. A module card retainer comprising:

a base closure having two elongate side walls connected to two U-shaped end walls and defining a slot therebetween;

two clamping arms each having a central plate and two side plates which are pivotably connected to two side wall portions of the U-shaped end wall and defining an inner channel between the central plate and the side plates;

a seat attached to each side wall portion of the U-shaped end wall and defining a cavity therein on inner walls of which retaining means is formed; and a locking member retained in the seat by the retaining means and cooperating with a bolt to fix the seat onto a mother board.

18. An arrangement for combining a locking member to a seat of a device, comprising:

a cavity formed in said seat for receiving said locking member therein;

retaining means formed on the seat and defining an upper opening;

said locking member including at least a head portion and a flange portion; whereby the head portion of the locking member can snugly extend through the upper opening and be restrained from a horizontal/diametrical movement with regard to the seat while the flange portion of the locking member abuts against the retaining means for preventing the locking member from vertical movement relative to the seat.

19. A module card retainer comprising:

a base closure having two elongate side walls connected to two end walls and defining a slot therebetween;

two clamping arms each having central plate and two side plates commonly defining an inner channel between the central plate and the side plates; and a folding mechanism provide on said clamping arms and the end walls for pivotably folding the clamping arms with regard to the base closure.

20. The retainer as claimed in claim 19, wherein the folding mechanism comprises positioning means for retaining the clamping arms in either a folded or an extended status with regard to the base closure.

* * * * *